United States Patent [19]

Lacroix et al.

[11] 4,060,995

[45] Dec. 6, 1977

[54] IMMERSION OF AN OFFSHORE WEIGHT-STRUCTURE HAVING TWO COMPARTMENTS

[75] Inventors: Roger Lacroix, Paris Cedex; Claude Lepère, Boulogne-sur-Seine, both of France

[73] Assignee: Sea Tank Co. S.A., Rungis Cede, France

[21] Appl. No.: 669,458

[22] Filed: Mar. 22, 1976

[30] Foreign Application Priority Data

Mar. 26, 1975 France ..... 75.09509

[51] Int. Cl.[2] ..... E02B 17/00

[52] U.S. Cl. ..... 61/92; 61/97; 114/264; 61/101

[58] Field of Search ..... 61/46, 46.5, 63, 86, 61/87, 92, 97; 114/.5 D, 125, 264, 265; 9/8 P

[56] References Cited

U.S. PATENT DOCUMENTS

| | | | |
|---|---|---|---|
| 2,318,685 | 5/1943 | Gross | 61/46.5 |
| 2,327,118 | 8/1943 | MacKnight | 61/46.5 |
| 2,528,089 | 10/1950 | Siecke et al. | 61/46.5 |
| 2,580,911 | 1/1952 | Harris | 61/46.5 |
| 2,938,353 | 5/1960 | Vorenkamp | 61/46.5 |
| 3,165,898 | 1/1965 | Elliott | 61/46.5 |
| 3,793,842 | 2/1974 | Lacroix | 61/46.5 |

*Primary Examiner*—Paul R. Gilliam
*Assistant Examiner*—Alex Grosz

[57] ABSTRACT

The invention relates to the immersion at a great depth of an offshore weight-structure comprising a concrete base having two multicellular compartments, the one being central and self-resistant and the other being peripheral and subjected to compensating pressures, at least one multitubular pylon fixed to the said base and having a working area installed above it out of the water, and an auxiliary float co-operating with each pylon. The invention is characterized in that ballasting is effected by partial filling of the said self-resistant central compartment to enable the beginning of the immersion to be effected and that the actual immersion is then effected by the action of the said auxiliary float having an elongated cylindrical shape and being partly filled and whose relative position in relation to the said base is varied by mechanical guiding means. The ratio between the number of self-resistant cells and the number of peripheral cells filled with crude oil is determined with a view to immersion of the said structure.

10 Claims, 11 Drawing Figures

IMMERSION OF AN OFFSHORE WEIGHT-STRUCTURE HAVING TWO COMPARTMENTS

The present invention concerns a method of immersing an offshore structure comprising a weight base made of concrete and having two multicellular compartments, at least one multitubular pylon fixed to said base and having installed above it a work area out of the water and a float co-operating with each pylon.

It is a known practice to use, for the immersion of light platforms, a method based on a certain geometrical configuration which is necessary for ensuring the stability of the said light platforms during the towing and the immersion thereof. For example, use is made of a base having large dimensions and constituted by peripheral floats in order to ensure stability, particularly during towing, the centre of gravity of the assembly being situated above the centre of buoyancy. Moreover, the work area is constituted by the top of a horizontal fluid-tight box forming a float and sliding, during the immersion, along the pylon. Since, such a float, which extends horizontally along the surface of the sea, is subjected to the pounding of the waves, whereas the base, from a certain depth onwards, is practically sheltered from the swell, the portion of the pylon comprised between the two is subjected to stresses and lashing which are detrimental both to the structure of the pylon and to the immersion operation.

The present invention relates to offshore structures designed to be immersed to depths of the order of two hundred metres. For such depths, a concrete base having a hollow structure which is fluid-tight would require prohibitive quantities of concrete. Such difficulty is overcome by providing a structure having two compartments of different kind:

- A self-resistant central compartment with thick walls up the whole height of the structure and representing a fraction of the total capacity of the said structure;
- An outside compartment which is not so high, which has thin walls subjected to compensating pressures by filling with crude oil, and which is in communication with the outside water during immersion and represents the other fraction of the total capacity of the said structure.

These compartments comprise internal stiffening walls and thus form cells certain of which communicate with each other, this attenuating the movements of the liquid in the body. By adjusting the ratio between the number of cells subjected to compensating pressures and the number of self-resistant cells, it is possible to effect the beginning of the immersion of the structure with an apparent weight which is as small as required. The solid column of conventional tanks for medium depths is replaced by at least one metallic pylon constituted by tubes having a small diameter, that is, the pylon is made of a tubular metal structure so as to limit, during operation, stresses due to the swell and, consequently, the moments which result therefrom during embedding and at the level of the base.

A hollow auxiliary float which can be ballasted and manoeuvred during the immersion operation so as to ensure precise control thereof, is combined with each pylon so as to control the immersion.

The essential characteristic of the invention is that ballasting is effected by partial filling of the said self-resistant central compartment to enable the beginning of the immersion to be effected and that the actual immersion is then effected by the action of the said auxiliary float having an elongated cylindrical shape and being partly filled and whose relative position in relation to the said base is varied by mechanical guiding means.

In order to make it easier to understand the invention, both as to its aims and the advantages obtained thereby, the description of one of the embodiments thereof, having no limiting character, is given in connection with the drawing, in which.

Figure 4:
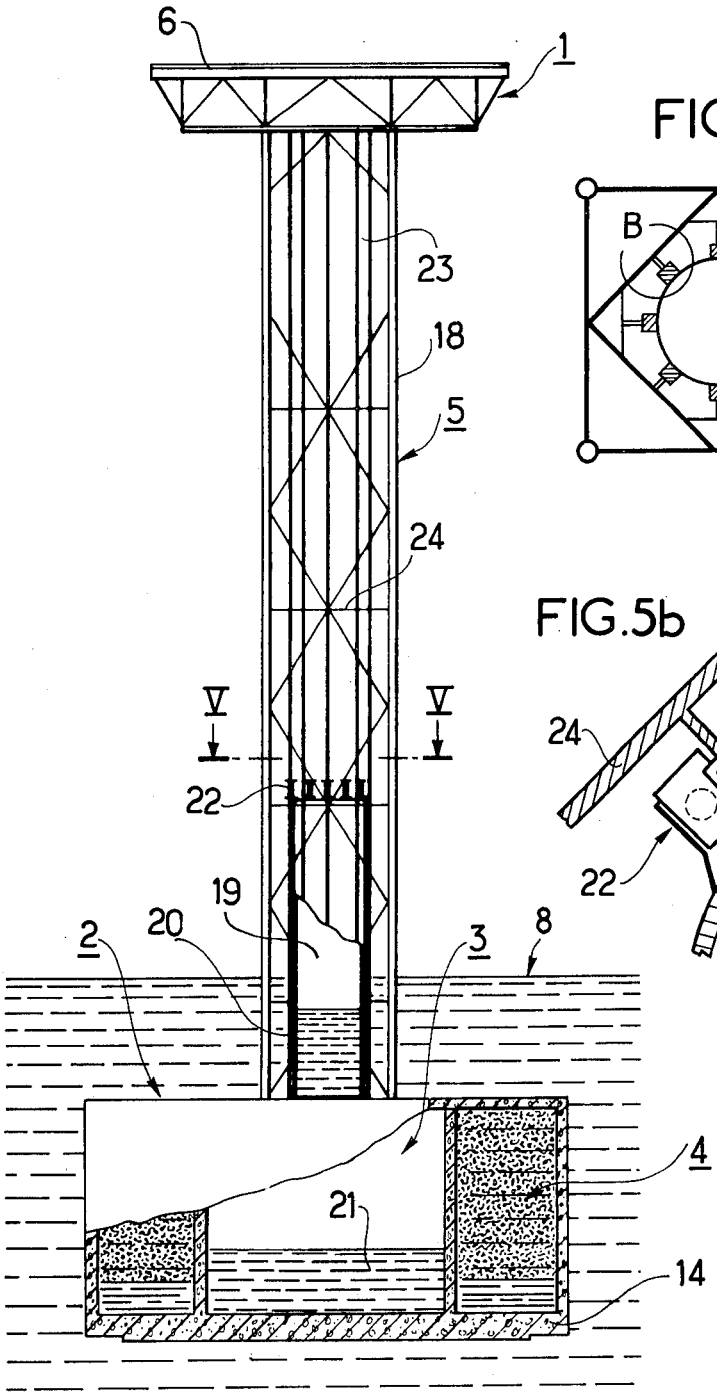
FIG. 4 shows the structure with only one pylon during immersion and indicates the levels of the liquids in the base and in the auxiliary float.
Figure 5A:
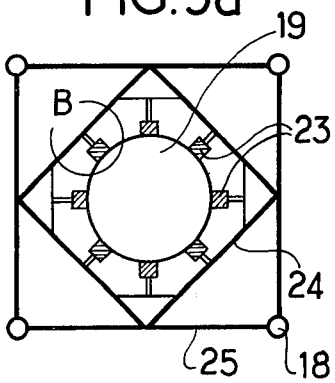

FIG. 5*a* is a horizontal diagrammatic cross-sectional view along V—V of the multitubular pylon in FIG. 4.

Figure 5B:
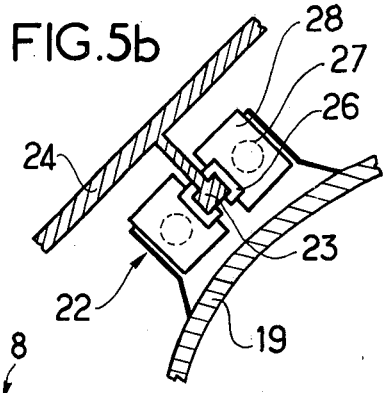

FIG. 5*b* is an enlarged view of the portion B of FIG. 5*a* relating to a jack fixed to the sliding float and having jaws surrounding a guide bar.

Figure 7:
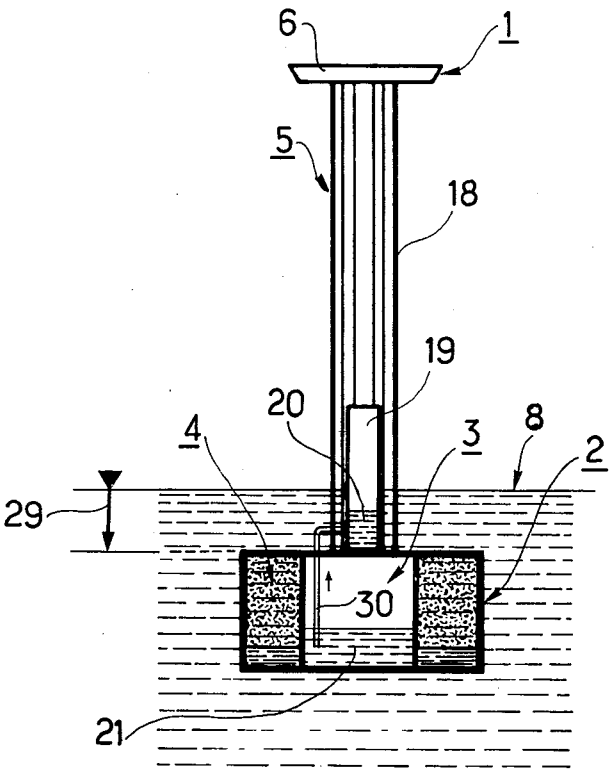
Figure 6:
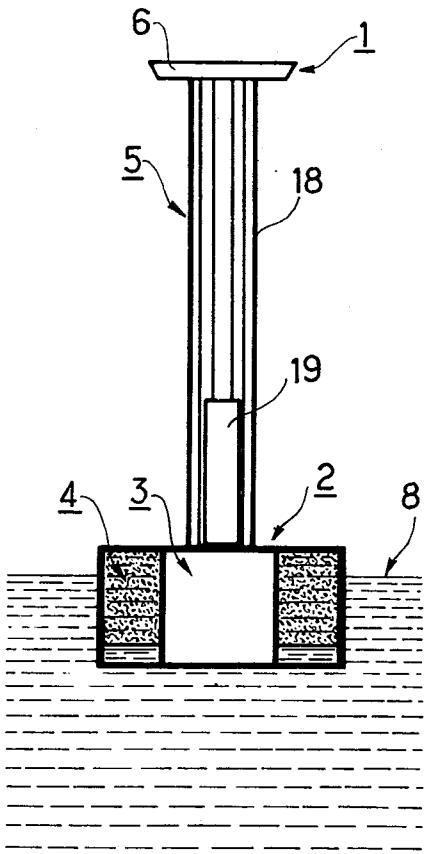

FIG. 6 shows the structure being towed. FIG. 7 shows the structure after the beginning of immersion and illustrates calibraton of the effort of the jacks.

Figure 10:
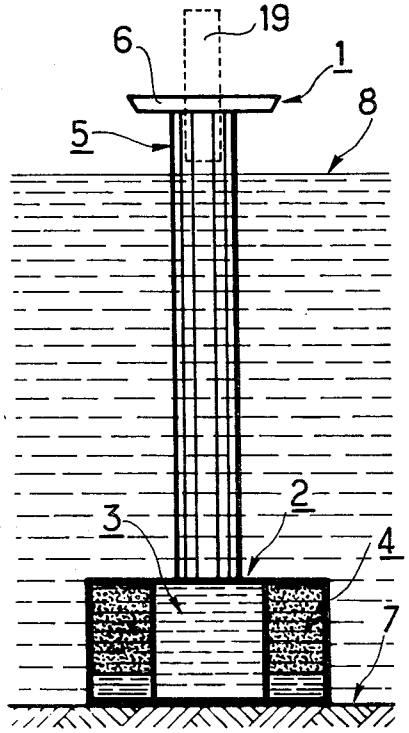
Figure 9:
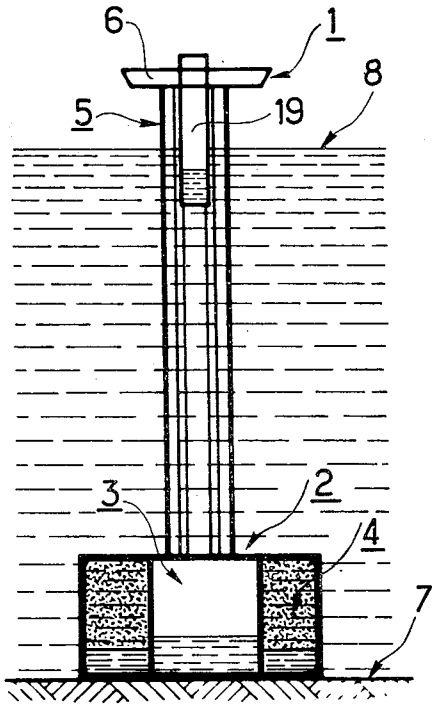
Figure 8:
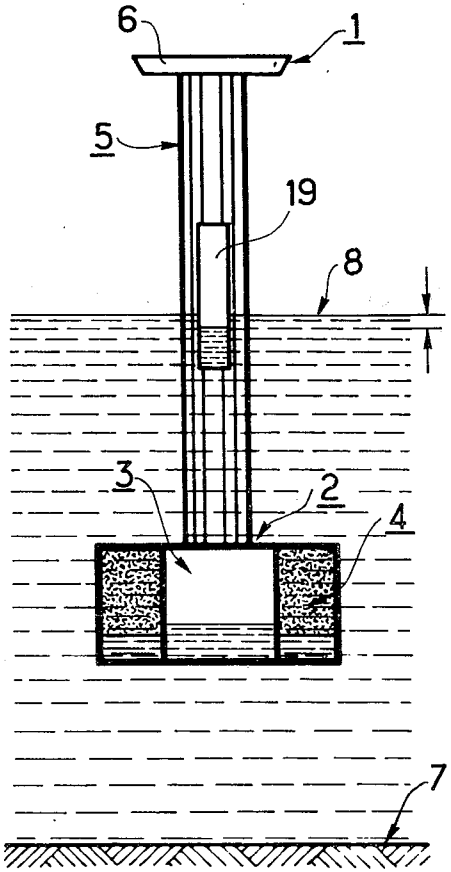

FIGS. 8, 9 and 10 show the structure during immersion, on landing on the sea bed and in operating condition, after extraction of the float, respectively.

Figure 1:
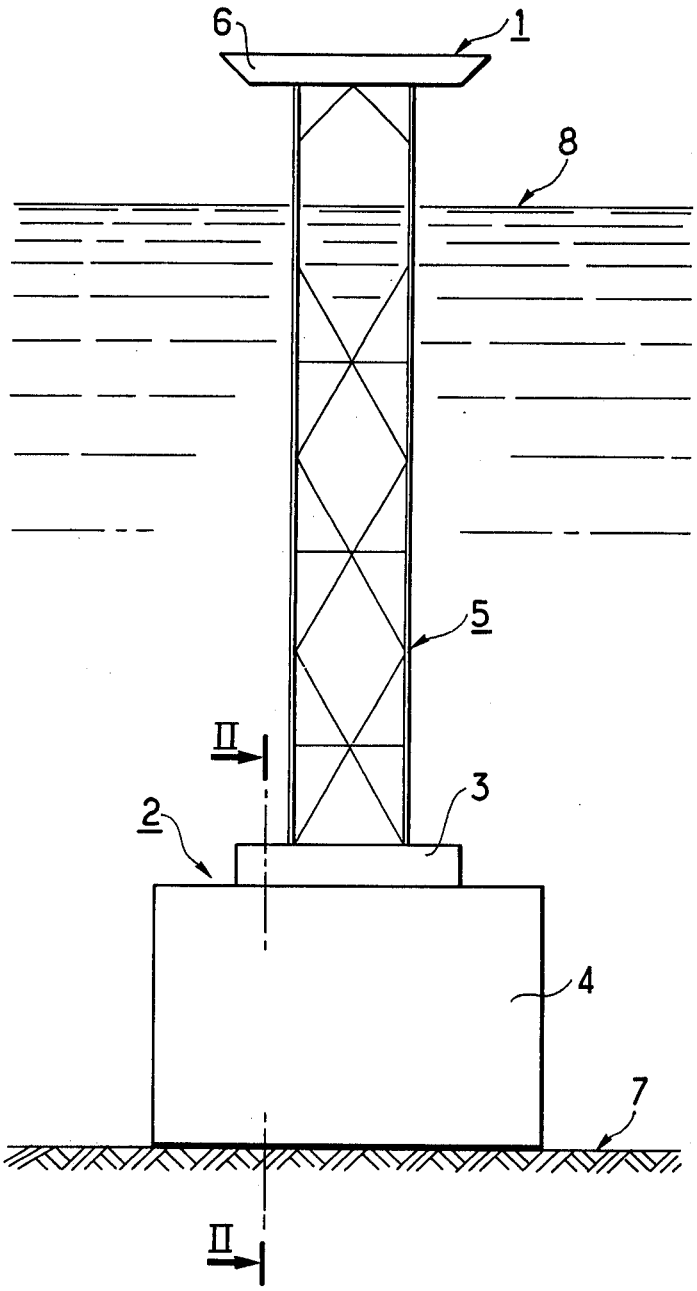
FIG. 1 is a diagrammatic elevational view of the weight structure resting on the sea bed after immersion.

In FIG. 1, the structure 1 in operating condition rests on the sea bed 7 by means of the raft of the concrete base 2. The work area 6 supported by the multitubular pylon 5 is situated out of the water, that is, at a sufficient height above the level of the sea 8.

Figure 2:
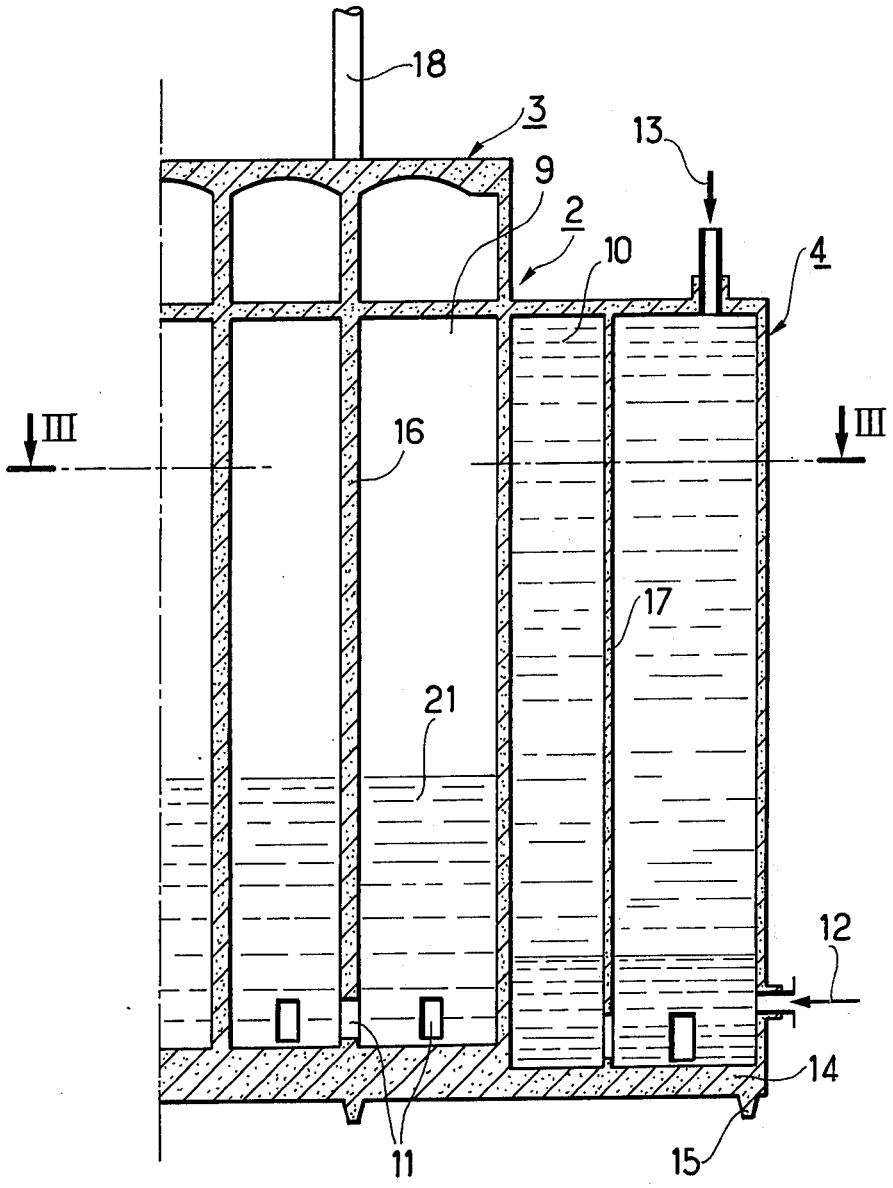
FIG. 2 is a vertical partial cross-sectional view along II—II in FIG. 1 of the concrete base having two multicellular compartments.
Figure 3:
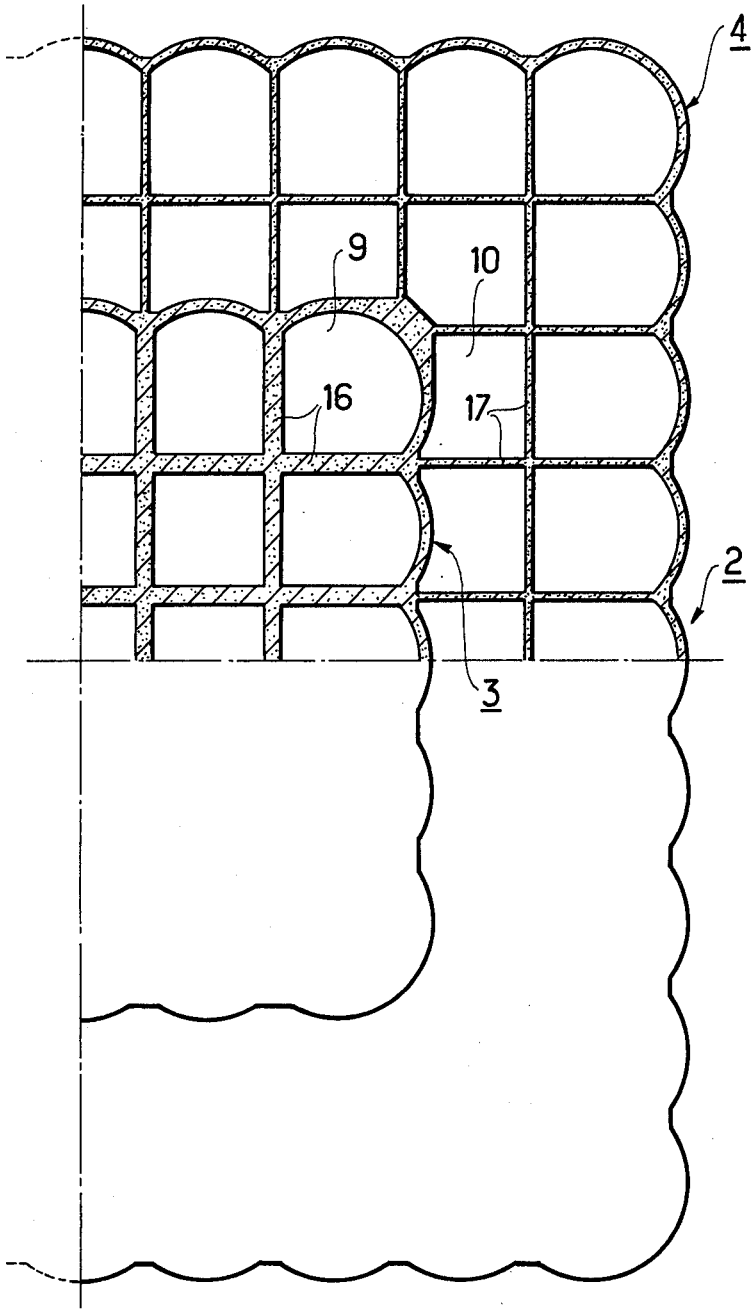
FIG. 3 is a horizontal partial cross-sectional view along III—III in FIG. 2 of the cells of the two types of compartments.

FIGS. 2 and 3 show partial cross-sectional vertical and horizontal views, respectively, of the multicellular compartments, that is one self-resistant compartment 3 and one subjected to compensating pressures peripheral compartment 4 and respectively comprising self-resistant cells 9 with thick walls 16 and peripheral cells 10 having thin walls 17. The raft 14 may or may not comprise fixing rims which dig into the sea bed. One of the tubes of the pylon 5 having a small outside diameter offering a minimum surface to be acted upon by the swell at the level of the sea's surface, is shown at 18. The ports 11 in walls 16 and 17 ensure the intercommunication between the cells of each compartment inside the base 2, whereas communication with the outside of the peripheral cells is effected through openings 12 and 13 indicated by arrows. The opening 13 serves for the supply of crude oil and the opening 12 for communication with the sea water which ensures precision in subjecting the peripheral cells to compensating pressures. The communication between the peripheral cells and the outside can be direct or via an antipollution device.

In FIG. 4, the structure 1 being immersed comprises an elongated cylindrical float 19 partly filled with water 20 and in communication with the water ballast 21 in the central compartment 3 of the base 2, in order to allow operation with a constant draft.

FIGS. 5*a* and 5*b* show double-acting hydraulic jacks 22 fixed out of the water on the upper part of the float 19 and ensuring, in a known way, the manoeuvring of the base 2 during the immersion by the alternating gripping action of a double set of jaws 26 on guide bars 23 arranged along the whole length of the pylon 5 and fixed on stiffeners 24 provided for that purpose between the distance-pieces 25 connecting together the tubes 18 of the said pylon 5. The cylinders of one of the jacks 22 are shown in dotted lines at 27. One of the pairs of jaws 26 is fixed on the support 28 of the jack while the other pair is fixed on the rod of the jack, the latter two components not being shown.

FIG. 6 shows the platform 1 being towed after the compartment 4 has been filled with crude oil, which is then subjected to compensating pressures, this being shown by a lower level of water in communication with the surrounding water. The float 19 rests on the self-resistant compartment 3 and is held by the jacks on the guide bars 23 and the stability of the assembly results from the position of its centre of gravity which is very far below its centre of buoyancy.

FIG. 7 shows how, by partial filling of the central compartment 3 with water 21, the immersion is begun, this being a discontinuous phenomenon because of the original extra ballasting necessary for overcoming the suction effect due to the swell at the time of the immersion of the roof of the tank 2. The result of this is a sinking referenced by the arrow 29, this being of the order of about ten metres. A pumping through the tube 30 of part of the water 21 from the compartment 3 into the float 19, as illustrated at 20, is provided. This makes it possible to limit, with a constant draft, the buoyancy of the said float 19 at the optimum level of use of the operating jacks.

FIG. 8 shows the structure 1 in the intermediate position between the surface 8 and the sea bed 7, the structure 1 being lowered progressively by the action of the operating jacks. The tank 2 having a light apparent weight is retained by the float 19. Variations in compressibility of the base and its contents are compensated for by the corresponding variations in the sinking of the said float 19. In the vicinity of the sea bed, the manoeuvring of the jacks may be slowed down as much as necessary to permit a precise and smooth landing on the sea bed 7.

In FIG. 9, the structure 1 rests on the sea bed 7 and the float 19 is balanced at the surface 8 of the sea, its elongated shape in the vertical direction giving little grip to the effect of the swell and representing an obvious improvement in relation to the horizontally extending boxes used up till now in current immersion operations.

In FIG. 10, by the action of the jacks bearing against the guiding bars 23, the auxiliary float 19 has been extracted from inside the pylon 5 after having been emptied to be recuperated, whereas the self-resistant compartment 3 has been completely filled with water to ensure the stability of the structure 1 which is ready to be put into service.

Such a structure can be used as a sub-marine crude oil storage tank, as a drilling platform, as a platform for offshore operations for working crude oil and for any other sub-marine use, particularly for oceanographic or mineral research or working operations.

The advantages of the immersion method become apparent from the description which has been given thereof: thus, the auxiliary floats can be recuperated after the immersion. The head loads of the pylon can be reduced to a minimum and the work are may be arranged after the immersion.

Inaccuracies relating to the actual weight of the structure, its exact geometrical shape, the variations in the density of the sea water according to the depth and the variations in the compressibility of the constituents with the pressure, result in only one inaccuracy in the relative position of the float in relation to the pylon which then ensures the overall compensation of the said inaccuracies. Furthermore, the method according to the invention avoids the necessity for any cable system whose use is recommended in the techniques of mooring buoys fixed to the sea bed, or, even, of boats or equivalent floating bodies. All these former devices do not allow a change in the direction of the stresses applied to the structure such as the rigid guiding bars according to the present invention allow it, thus removing the dangers entailed up till now by the effect of the swell.

It is self-evident that the description given has no exhaustive character and that all means equivalent to those set forth in the general definition of the invention form a part thereof.

More particularly, a single pylon has been described for the simplification of the description; but for depths in the order of two hundred metres and more, several pylons which may be braced together and which may each comprise inside it a sliding and guided elongated float, can also be provided. It may prove to be an advantage, also, to provide only one pylon having a structure of the Eiffel Tower type, comprising, inside it, the network of cylindrical guiding bars necessary for guiding the auxiliary float inside it.

We claim:

1. A method of immersing an offshore structure which includes a self-resistant base, a multitubular pylon fixed to the base and having guiding bars extending lengthwise thereof a working area installed on the pylon, an auxiliary hollow float mounted on the pylon and jack means for releasably clamping the float to the guiding bars for varying the relative positions of the base and the float, and wherein the base comprises a central multicellular compartment and a peripheral multicellular compartment the interior of which is adapted to communicte with the surrounding water as well as with a source of pressure fluid compensating for the pressure of the surrounding water, the method comprising:

a. initiating immersion of the base by partially filling the central compartment with liquid; and b. thereafter continuing immersion of the base by admitting additional liquid into the central compartment, lowering the base relative to the float by clamping the float to the guiding bars and pumping liquid from the central compartment into the float, the pumping permitting the load on the jack means to be restricted at a substantially constant draft whereby the jack means is usable to great depths.

2. Method according to claim 1 wherein the pumping of liquid from the central compartment into the float is performed periodically during the immersion.

3. Method according to claim 1 wherein the float has an elongated cylindrical shape and is only partly filled with liquid during the immersion.

4. Method according to claim 1, wherein immersion is made easier by obtaining a light apparent weight by means of a determined ratio between the number of self-resistant cells and the number of cells subjected to compensating pressures.

5. Method according to claim 1 wherein the each auxiliary float is confined within the inside space of the pylon.

6. Method according to claim 1, wherein the jack means comprises double-acting hydraulic jacks installed at the upper part of the float and each bearing, by a system of two pairs of jaws connected respectively to their cylinder and to their rod, on said guiding bars spaced out round the periphery and arranged along the entire height of the pylon.

7. Method according to claim 6, wherein at the beginning of immersion, a part of the liquid in the self-resistant compartment is transferred by pumping to the float to limit the buoyancy of the float to the optimum value for the use of the jacks.

8. Method according to claim 7, wherein by the action of the jacks and of the alternate gripping of the said jacks on the guiding bars, the lowering of the said structure is ensured by the effect of its light apparent weight until the laying of the base on the sea bed followed by the complete filling of the self-resistant compartment.

9. Method according to claim 8 wherein the float, after emptying, is taken out of the water by the action of the jacks and is recuperated.

10. Method according to claim 8 wherein the float is sent back down to the sea bed by corresponding ballasting after recuperation of its jacks.

* * * * *